US007057113B1

(12) United States Patent
Chen

(10) Patent No.: US 7,057,113 B1
(45) Date of Patent: Jun. 6, 2006

(54) ELECTRIC WIRE

(76) Inventor: Chi-Wen Chen, No. 105, Alley 27, Lane 143, Chun-Kung Rd., Taipei City (TW)

( * ) Notice: Subject to any disclaimer, the term of this patent is extended or adjusted under 35 U.S.C. 154(b) by 0 days.

(21) Appl. No.: 11/143,625

(22) Filed: Jun. 3, 2005

(51) Int. Cl.
*H01B 7/00* (2006.01)

(52) U.S. Cl. ..... 174/110 R; 174/113 R; 174/115

(58) Field of Classification Search ..... 174/36, 174/110 R, 113 R, 115, 116, 120 R, 120 AR
See application file for complete search history.

(56) References Cited

U.S. PATENT DOCUMENTS 2,583,025 A * 1/1952 Swift et al. ..... 174/117 R
3,697,671 A * 10/1972 Parker ..... 174/115
4,543,448 A * 9/1985 Deurloo ..... 174/112
4,687,294 A * 8/1987 Angeles ..... 385/102
4,920,234 A * 4/1990 Lemke ..... 174/36
5,329,065 A * 7/1994 Marney et al. ..... 174/128.1
6,127,632 A * 10/2000 Oswald et al. ..... 174/120 R
6,498,300 B1 * 12/2002 Flick ..... 174/110 R

* cited by examiner

*Primary Examiner*—William H. Mayo, III
(74) *Attorney, Agent, or Firm*—Pearl Cohen Zecek Latzer LLP

(57) ABSTRACT

An electric wire includes a core unit including at least two sheathed wires that are helically twisted together about a central axis, and a sheath surrounding the core unit. Each of the sheathed wires includes an insulation layer and a conductive core surrounded by the insulation layer. The sheath is helically twisted about the central axis, and has an outer layer that is helically twisted about the central axis and that has a cross-section which includes a plurality of first crest regions and a plurality of second crest regions that are alternately disposed with the first crest regions. Each of the first crest regions cooperates with an adjacent one of the crest regions to define a trough region therebetween. The distance from each of the first crest regions to the central axis is different from that from each of the second crest regions to the central axis.

3 Claims, 4 Drawing Sheets

ELECTRIC WIRE

BACKGROUND OF THE INVENTION

1. Field of the Invention

This invention relates to an electric wire for conducting electric power to electrical devices, more particularly to an electric wire including a core unit and a sheath having an appealing appearance.

2. Description of the Related Art

Referring to FIG. 1, a typical electric wire 1 includes a core unit 10 and a plastic sheath 12 surrounding the core unit 10. The core unit 10 includes a plurality of insulated wires 11 parallel to each other along a central axis 13. Each of the insulated wires 11 has a plastic insulation layer 112 and a conductive core 111 surrounded by the plastic insulation layer 112.

Generally, manufacture of the conventional electric wire 1 is focused on achievement of conducting electricity and involves the steps of: applying the insulation layer 112 to each of the conductive cores 111 to form the insulated wires 11; arranging the insulated wires 11 to be parallel to each other, so as to form the core unit 10; and applying the sheath 12 to surround the core unit 10. The electric wire 1 is subsequently mounted on an electrical device for conducting electric power through a plug-and-socket unit. Hence, the electric wire 1 will be exposed outside the electrical device and is movable together therewith. In other words, the electric wire 1 has an influence on consumers' impression on the electrical device. Conventionally, the electric wire 1 is decorated by using a color sheath 12. Apparently, such dull and inflexible design of the electric wire 1 cannot satisfy the requirement of persons living in modern times for pursuing novel or fresh things. Therefore, there is a need in the art to provide an electric wire having an appealing appearance.

SUMMARY OF THE INVENTION

Therefore, the object of the present invention is to provide an electrical wire that is clear of the aforesaid drawback of the prior art.

According to this invention, an electric wire includes a core unit and a sheath surrounding the core unit. The core unit includes at least two sheathed wires that are helically twisted together about a central axis. Each of the sheathed wires includes an insulation layer and a conductive core surrounded by the insulation layer. The sheath is helically twisted about the central axis, and has an outer layer that is helically twisted about the central axis and that has a cross-section which includes a plurality of first crest regions and a plurality of second crest regions that are alternately disposed with the first crest regions. Each of the first crest regions cooperates with an adjacent one of the second crest regions to define a trough region therebetween. The distance from each of the first crest regions to the central axis is different from that from each of the second crest regions to the central axis.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
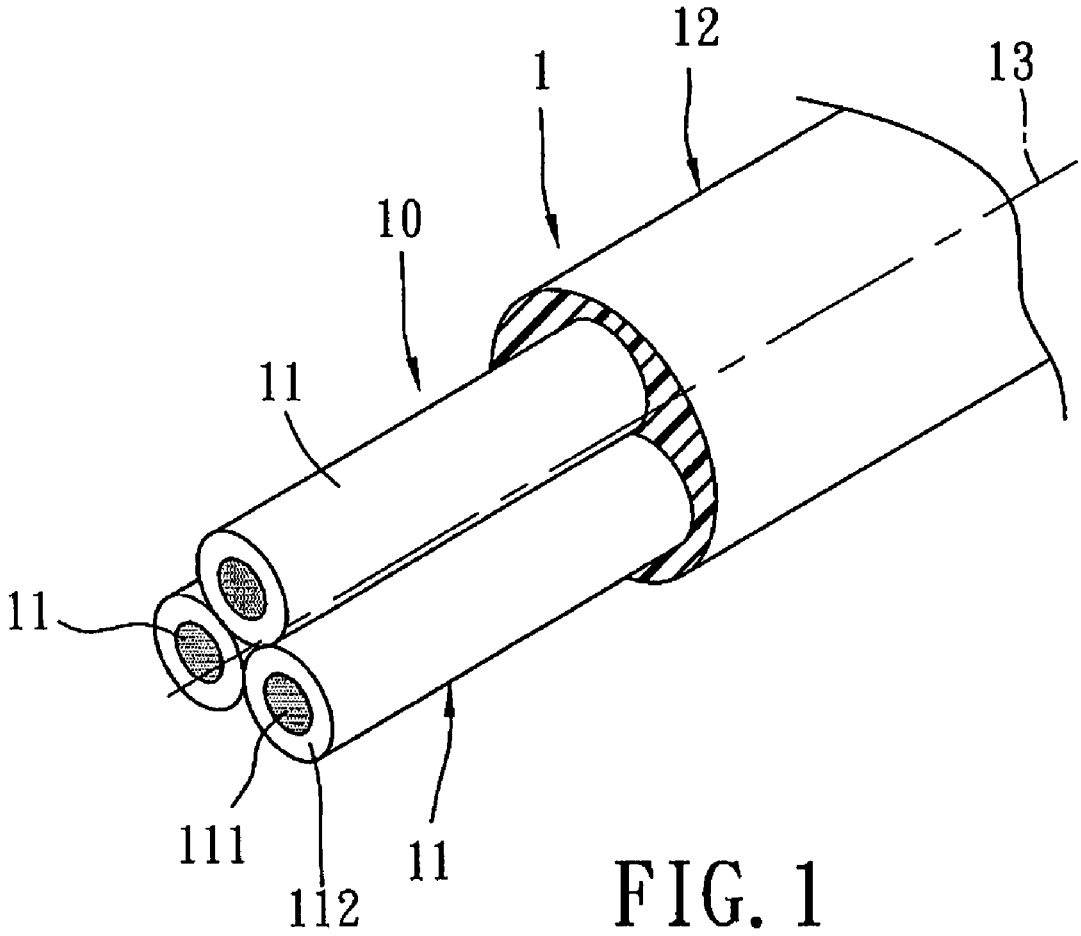
FIG. 1 PRIOR ART
FIG. 1 is a fragmentary cutaway perspective view to illustrate a conventional electric wire.
Figure 2:
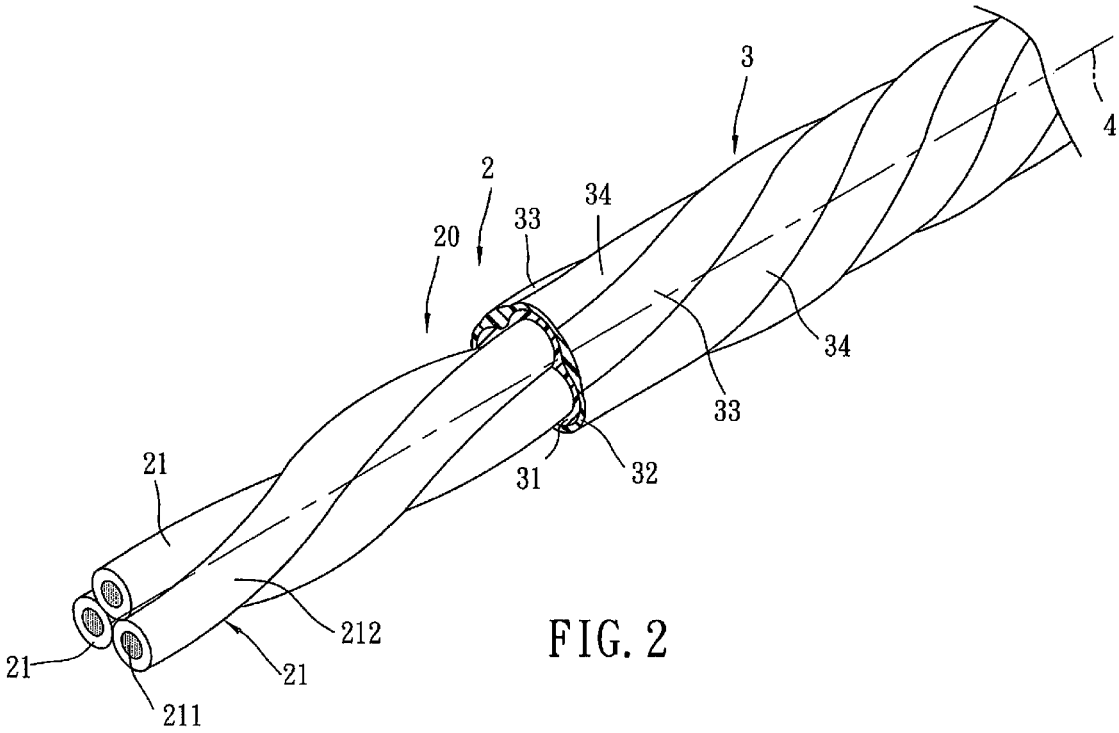
FIG. 2 is a fragmentary cutaway perspective view to illustrate the preferred embodiment of an electric wire according to the present invention.
Figure 3:
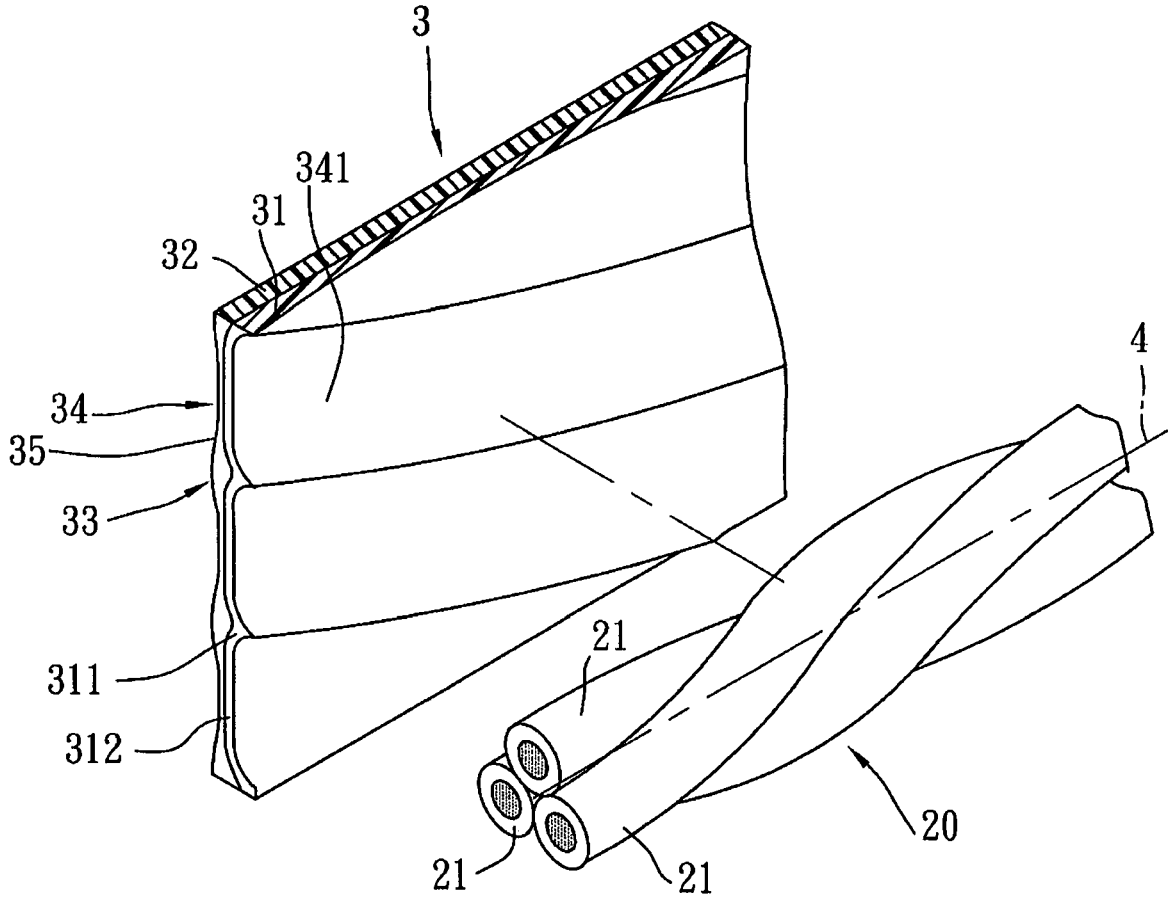
FIG. 3 is an exploded perspective view to illustrate structures of a core unit and a sheath of the electric wire of FIG. 2.
Figure 4:
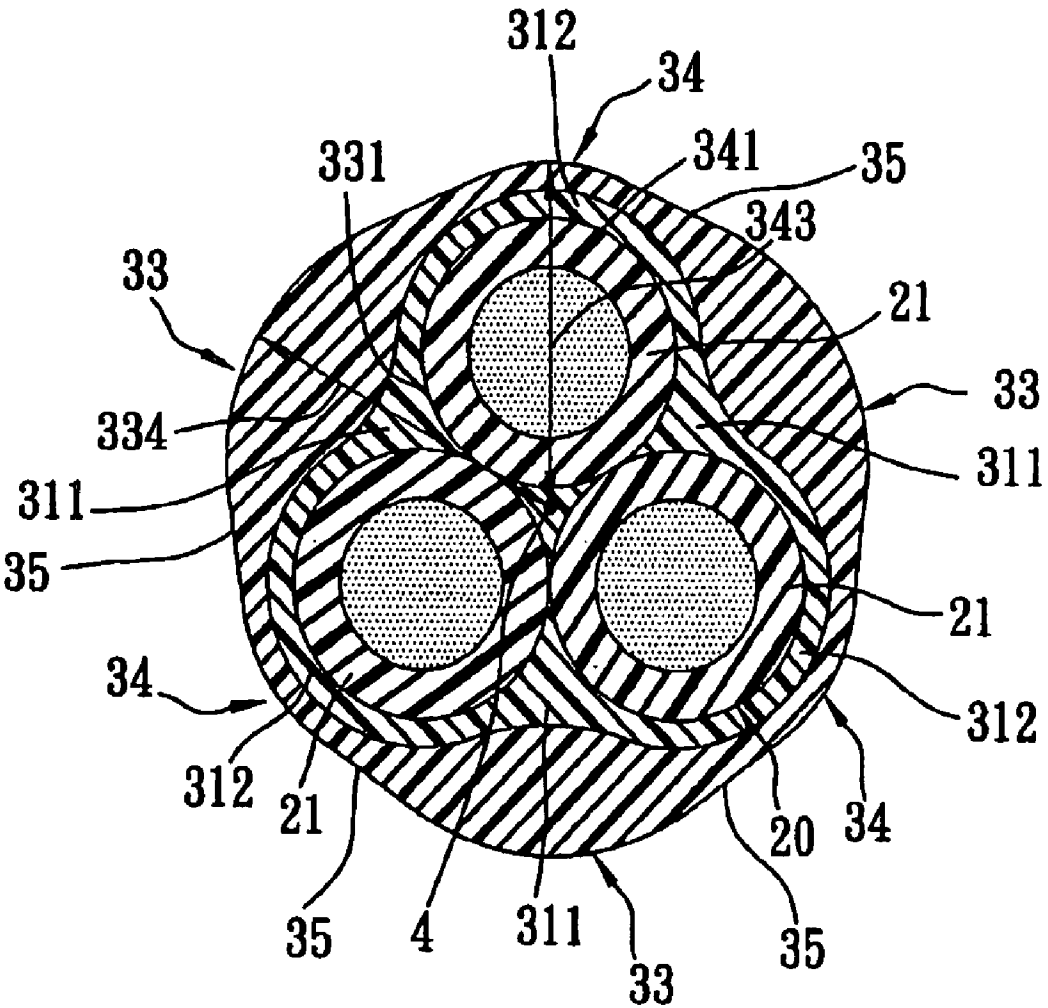
FIG. 4 is a cross-sectional view to illustrate structural arrangement of the core unit and the sheath of the electric wire of FIG. 2.

Referring to FIGS. 2, 3, and 4, the preferred embodiment of an electric wire 2 according to the present invention includes a core unit 20 and a sheath 3 surrounding the core unit 20. The core unit 20 includes at least two sheathed wires 21 that are helically twisted together about a central axis 4. Each of the sheathed wires 21 includes an insulation layer 212 and a conductive core 211 surrounded by the insulation layer 212. Preferably, the core unit 20 includes one live wire and one neutral wire. More preferably, the core unit 20 includes one live wire, one neutral wire, and one ground wire.

The sheath 3 is helically twisted about the central axis 4, and has an outer layer 32 that is helically twisted about the central axis 4 and that has a cross-section which includes a plurality of first crest regions 33 and a plurality of second crest regions 34 that are alternately disposed with the first crest regions 33. Each of the first crest regions 33 cooperates with an adjacent one of the second crest regions 34 to define a trough region 35 therebetween. The distance 334 from each of the first crest regions 33 to the central axis 4 is different from the distance 343 from each of the second crest regions 34 to the central axis 4. Preferably, the distance 334 from each of the first crest regions 33 to the central axis 4 is greater than the distance 343 from each of the second crest regions 34 to the central axis 4.

The outer layer 32 may be made from a translucent or transparent material, such as translucent or transparent PVC. In this preferred embodiment, the outer layer 32 is made from translucent milk-white PVC.

Preferably, the sheath 3 further includes an inner layer 31 sandwiched between the core unit 20 and the outer layer 32 and including a plurality of crest regions 312, and a plurality of trough regions 311. Each of the through regions 311 is formed between two adjacent ones of the crest regions 312 of the inner layer 31. Each of the trough regions 311 of the inner layer 31 is registered with a respective one of the first crest regions 33 of the outer layer 32. Each of the crest regions 312 of the inner layer 31 is registered with a respective one of the second crest regions 34 of the outer layer 32.

In addition, the inner layer 3 may be made from a color plastic material. Precisely, the inner layer 3 is made from a color PVC.

According to the present invention, by virtue of the helically twisted character of the outer layer 32, and by virtue of the difference between the distance 334 from each of the first crest regions 33 to the central axis 4 and the distance 343 from each of the second crest regions 34 to the central axis 4, the electric wire 2 will have a novel and fresh appearance. In addition, when the outer layer 32 is made from a translucent or transparent plastic material and the inner layer 31 is made from a color plastic material, the electric wire 2 will have an appearance exhibiting gradation of the color of the inner layer 31, so as to further improve the appealing character of the electric wire 2.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

I claim:

1. An electric wire, comprising:

a core unit including at least two sheathed wires that are helically twisted together about a central axis, each of said sheathed wires comprising an insulated layer and a conductive core surrounded by said insulation layer; and a sheath surrounding said core unit, helically twisted about said central axis, and comprising an outer layer that is helically twisted about said central axis and that has a cross-section which includes a plurality of first crest regions and a plurality of second crest regions that are alternately disposed with said first crest regions, each of said first crest regions cooperating with an adjacent one of said second crest legions to define a trough region therebetween;

wherein the distance from each of said first crest regions to said central axis is different from that from each of said second crest regions to said central axis;

wherein said sheath comprises an inner layer sandwiched between said core unit and said outer layer and including a plurality of crest regions, and a plurality of trough regions, each of said through regions of said inner layer being formed between two adjacent ones of said crest regions of said inner layer, each of said trough regions of said inner layer being registered with a respective one of said first crest regions of said outer layer, each of said crest regions of said inner layer being registered with a respective one of said second crest regions of said outer layer.

2. The electric wire as claimed in claim 1, wherein the distance from each of said first crest regions to said central axis is greater than that from each of said second crest regions to said central axis.

3. The electric wire as claimed in claim 2, wherein said sheath further includes an inner layer sandwiched between said core unit and said outer layer and including a plurality of crest regions, and a plurality of trough regions, each of said through regions of said inner layer being formed between two adjacent ones of said crest regions of said inner layer, each of said trough regions of said inner layer being registered with a respective one of said first crest regions of said outer layer, each of said crest regions of said inner layer being registered with a respective one of said second crest regions of said outer layer.

* * * * *